US011560724B2

(12) United States Patent
Mendiluza

(10) Patent No.: US 11,560,724 B2
(45) Date of Patent: Jan. 24, 2023

(54) CONFIGURABLE TILE LEVELER

(71) Applicant: EVENTILE USA, LLC, Cape Coral, FL (US)

(72) Inventor: Raunier Mendiluza, Cape Coral, FL (US)

(73) Assignee: Even Tile USA, LLC, Cape Coral, FL (US)

( * ) Notice: Subject to any disclaimer, the term of this patent is extended or adjusted under 35 U.S.C. 154(b) by 294 days.

(21) Appl. No.: 16/945,674

(22) Filed: Jul. 31, 2020

(65) Prior Publication Data

US 2021/0032884 A1 Feb. 4, 2021

Related U.S. Application Data

(60) Provisional application No. 62/881,481, filed on Aug. 1, 2019.

(51) Int. Cl.

| | |
|---|---|
| ***E04F 21/18*** | (2006.01) |
| ***E04F 21/22*** | (2006.01) |
| ***E04F 21/00*** | (2006.01) |

(52) U.S. Cl.

CPC ..... *E04F 21/1877* (2013.01); *E04F 21/0092* (2013.01); *E04F 21/22* (2013.01)

(58) Field of Classification Search

CPC ..... E04F 13/0892; E04F 21/1877; E04F 21/0092; E04F 21/22; E04F 15/02022

See application file for complete search history.

(56) References Cited

U.S. PATENT DOCUMENTS

| | | | | |
|---|---|---|---|---|
| 3,861,098 | A * | 1/1975 | Schaub | E04D 11/005 52/263 |
| 5,288,534 | A * | 2/1994 | Tavshanjian | E04F 21/0092 52/DIG. 1 |
| 5,363,560 | A | 11/1994 | Makow | |
| 6,625,951 | B1 * | 9/2003 | McCarthy | E04F 21/0092 52/749.11 |
| D678,039 | S * | 3/2013 | Psaila | D8/354 |
| 2014/0366461 | A1 * | 12/2014 | Busby | E04F 15/02183 52/126.6 |

FOREIGN PATENT DOCUMENTS

| | | | | |
|---|---|---|---|---|
| AT | 509463 | B1 * | 9/2011 | E04D 11/005 |
| DE | 202005018562 | U1 * | 3/2006 | E04D 11/005 |
| DE | 202010004615 | U1 * | 8/2010 | E04F 15/02005 |
| DE | 202011103629 | U1 * | 4/2012 | E04F 15/02022 |
| DE | 202014104313 | U1 * | 11/2014 | E01C 5/001 |

* cited by examiner

*Primary Examiner* — Babajide A Demuren

(74) *Attorney, Agent, or Firm* — Kunzler Bean & Adamson; Scott D. Thorpe

(57) ABSTRACT

For leveling tiles, a tile leveler includes a base, a plurality of joint spacers, and two or more break lines. The brake lines are formed in the base along planar axes. Each joint spacer is within a subdivision distance of a break line. Each joint spacer adjacent to a given break line is on a spacer side of the given break line, and the break lines divide the base into sections.

8 Claims, 8 Drawing Sheets

CONFIGURABLE TILE LEVELER

CROSS REFERENCE TO RELATED APPLICATIONS

This application claims priority to U.S. Provisional Application No. 62/881,481 entitled "CONFIGURABLE TILE LEVELER" and filed on Aug. 1, 2019 for Raunier Mendiluza, which is incorporated herein by reference.

BACKGROUND

Field

The subject matter disclosed herein relates to a tile leveler and more particularly relates to a configurable tile leveler.

Description of the Related Art

Different tile levelers have been required for different tasks.

BRIEF DESCRIPTION OF THE DRAWINGS

A more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to," unless expressly specified otherwise. An enumerated listing of items does not imply that any or all of the items are mutually exclusive, unless expressly specified otherwise. The terms "a," "an," and "the" also refer to "one or more" unless expressly specified otherwise. The term "and/or" refers to any or combinations, such as "A," "B," or "A and B" for elements "A and/or B."

The description of elements in each figure may refer to elements of proceeding figures. Like numbers refer to like elements in all figures, including alternate embodiments of like elements.

Figure 1:
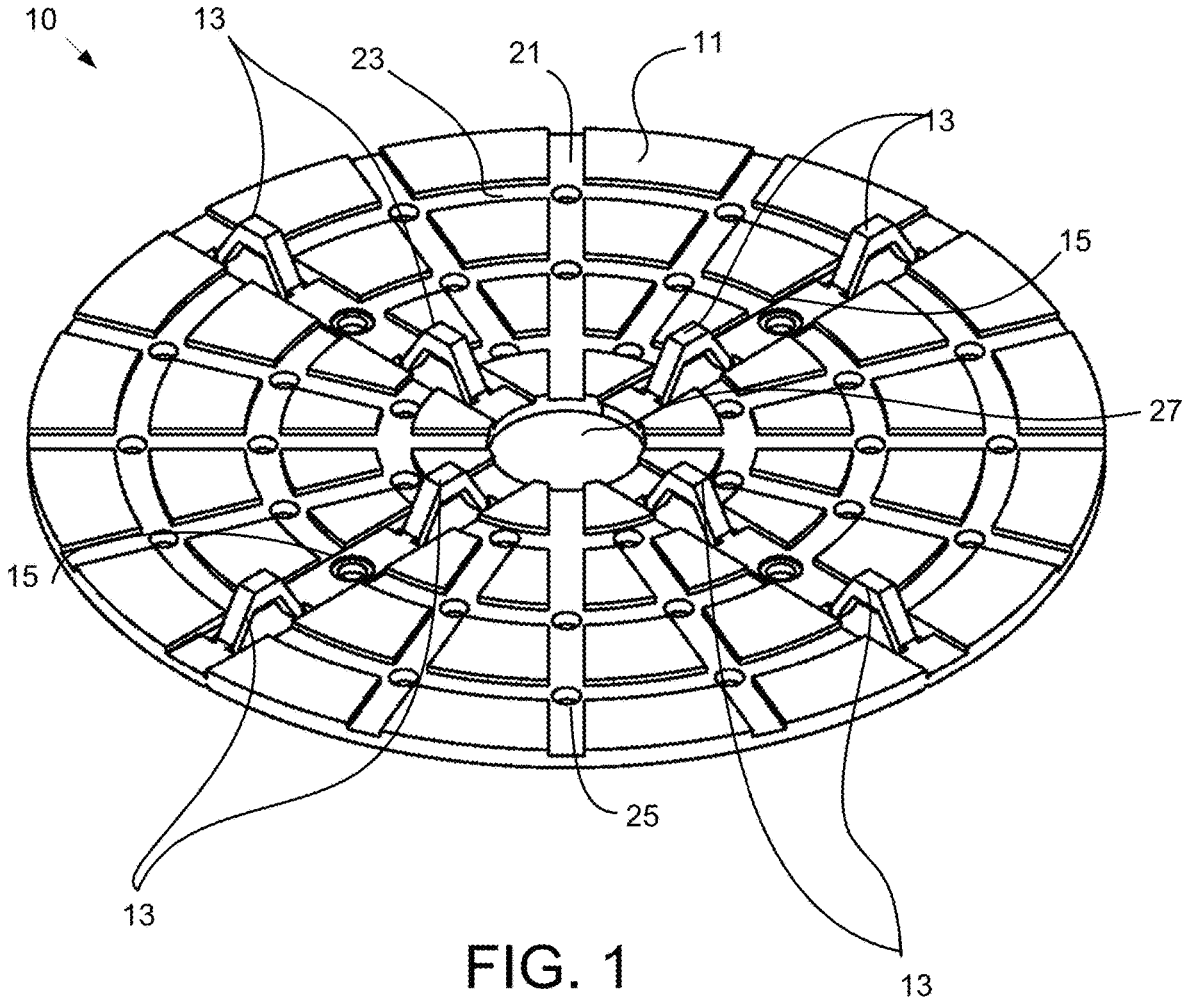
FIG. 1 is a perspective drawing illustrating one embodiment of a tile leveler.

FIG. 1 is a perspective drawing illustrating one embodiment of a tile leveler 10. The tile leveler 10 may securely position one or more tiles for installation. In the depicted embodiment, the tile leveler 10 includes a base 11 and a plurality of joint spacers 13. Mortar may be added under, on and/or around the tile spacer 10. A tile may be disposed on the base 11 with an edge of the tile abutting the joint spacers 13. With the tile spacer 10 so positioned, the mortar is allowed to harden with the tile in the correct position.

The tile leveler 10 may be molded as a single unit. The tile leveler 10 may be formed of an organic polymer. In addition, the tile leveler 10 may be a plastic. Two or more break lines 15 are formed in the base 11. In the depicted embodiment, two break lines 15 are formed in the base 11. In the depicted embodiment, the base 11 is circular. The base 11 may also be rectangular.

The base 11 may comprise two or more radial trenches 21. For clarity, only representative radial trenches 21 are labeled. In one embodiment, a brake line 15 is disposed in a radial trench 21. The base 11 may further comprise two or more circular trenches 23. For clarity, only representative circular trenches 23 are labeled. In addition, the base 11 may comprise two or more mortar passages 25. For clarity, representative mortar passages 25 are labeled. Mortar passages 25 may be circular holes. In addition, mortar passages 25 may be rectangular holes. In one embodiment, mortar passages 25 are shaped holes. Each mortar passage 25 may be disposed in a radial trench 21 and/or a circular trench 23. The mortar passage 25 may allow mortar to pass from a bottom of the base 11 to a top of the base 11.

In the depicted embodiment, a hole 27 is formed in the base 11. The hole 27 may also function as a mortar passage 25.

Figure 2:
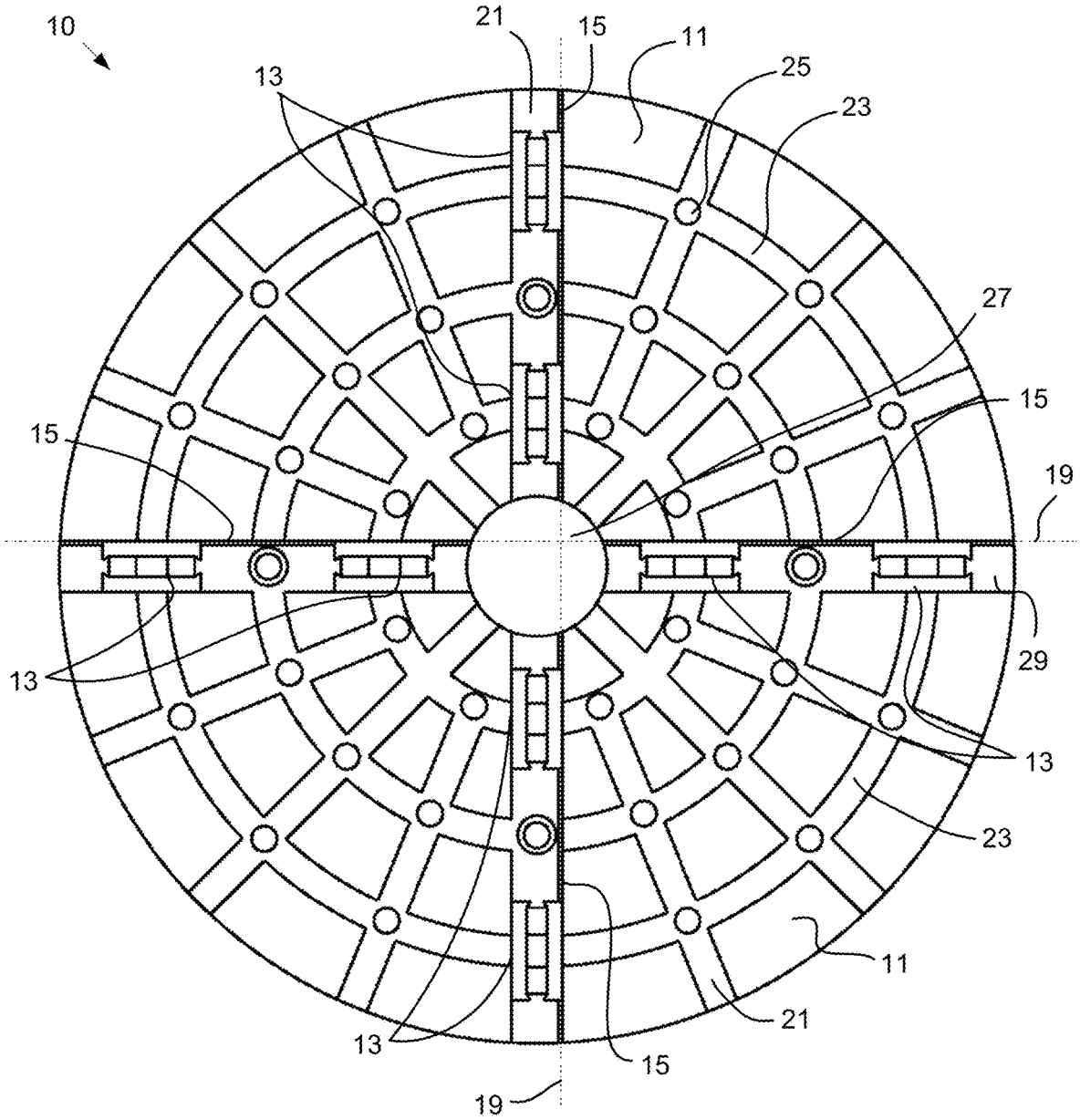
FIG. 2 is a top view drawing illustrating one embodiment of a tile leveler.

FIG. 2 is a top view drawing illustrating one embodiment of a tile leveler 10. In the depicted embodiment, planar axes 19 are shown. The planar axes 19 may be coplanar with the base 11. In the depicted embodiment, two planar axes 19 are shown. However, any number of planar axes 19 may be employed. The brake lines 15 are formed in the base 11 along the planar axes 19. Each joint spacer 13 may be within a subdivision distance of a break line 15. The subdivision distance may be greater than 1 millimeter. In addition, joint spacers 13 may be adjacent to a given break line 15. Joint spacers 13 that are adjacent to a given break line 15 are on a spacer side 31 of the given break line 15. In one embodiment, the break lines 15 divide the base 11 into sections.

Figure 3:
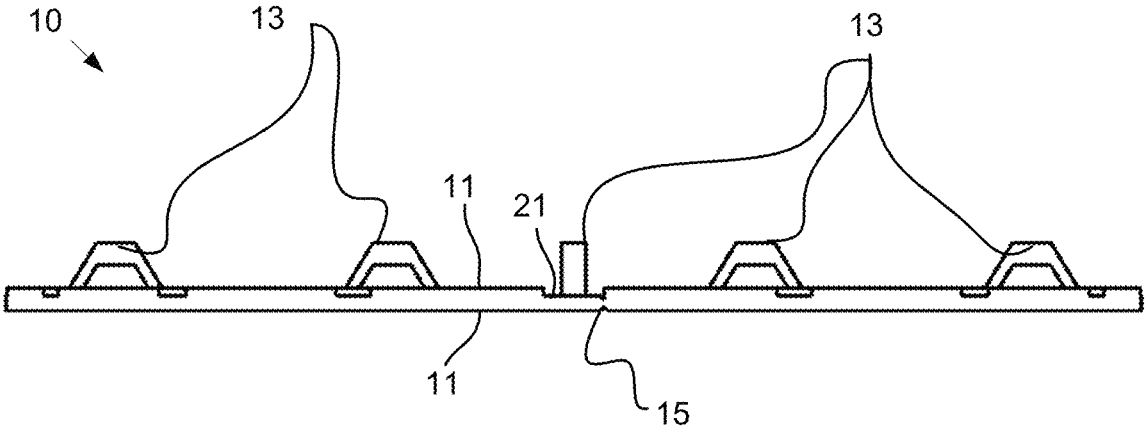
FIG. 3 is a side view drawing illustrating one embodiment of a tile leveler.

FIG. 3 is a side view drawing illustrating one embodiment of a tile leveler 10. The joint spacers 13, a radial trench 21, and a break line 15 are shown.

Figure 4A:
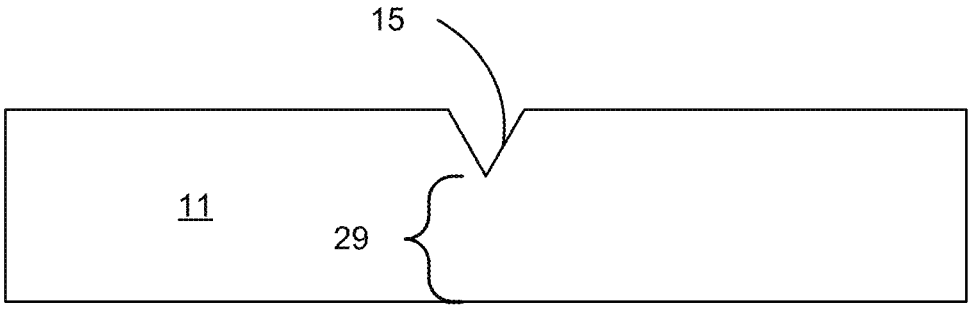
FIG. 4A is a side view drawing illustrating one embodiment of a break line.

FIG. 4A is a side view drawing illustrating one embodiment of a break line 15 in the base 11. In the depicted embodiment, the brake line 15 is formed as an angled trench in the base 11. The angled trench may result in a segment of base material of the base 11 being thinned to a break thickness 29 in the range of 1.0 to 1.5 millimeters. In an alternative embodiment, the brake line 15 may be formed as a rectangular trench in the base 11. The brake line 15 may be formed on the top of the base 11 and/or on the bottom of the base 11.

Figure 4B:
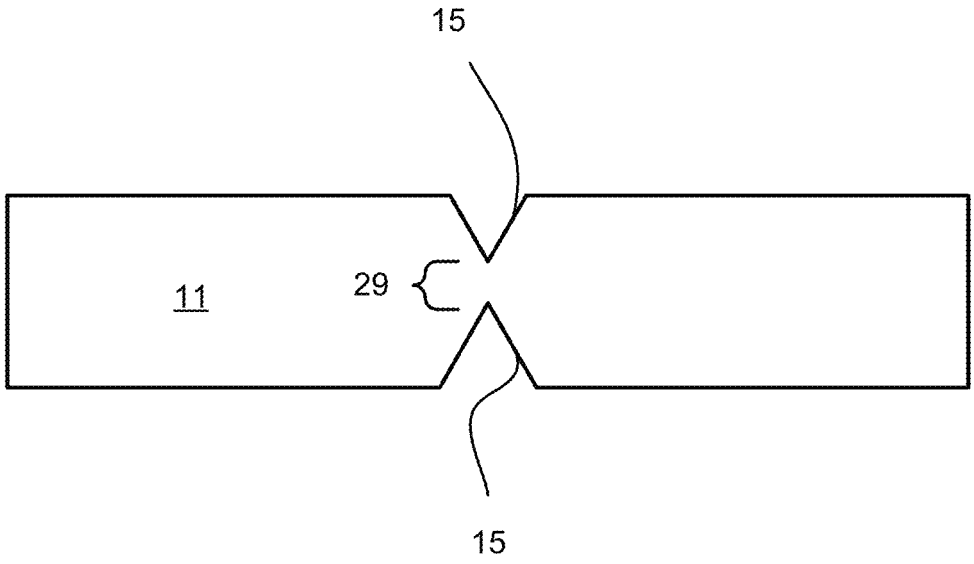
FIG. 4B is a side view drawing illustrating one alternate embodiment of a break line.

FIG. 4B is a side view drawing illustrating one alternate embodiment of a break line 15 in the base 11. In the depicted embodiment, two angled trenches are formed in the base 11. The angled trenches may thin the segment of base material to a break thickness 29 the range of 1.0 to 1.5 millimeters. The break thickness 29 may be selected so that bending a section of the base 11 back and forth along the brake line 15 separates segments of the base 11 along the brake line 15.

Figure 5:
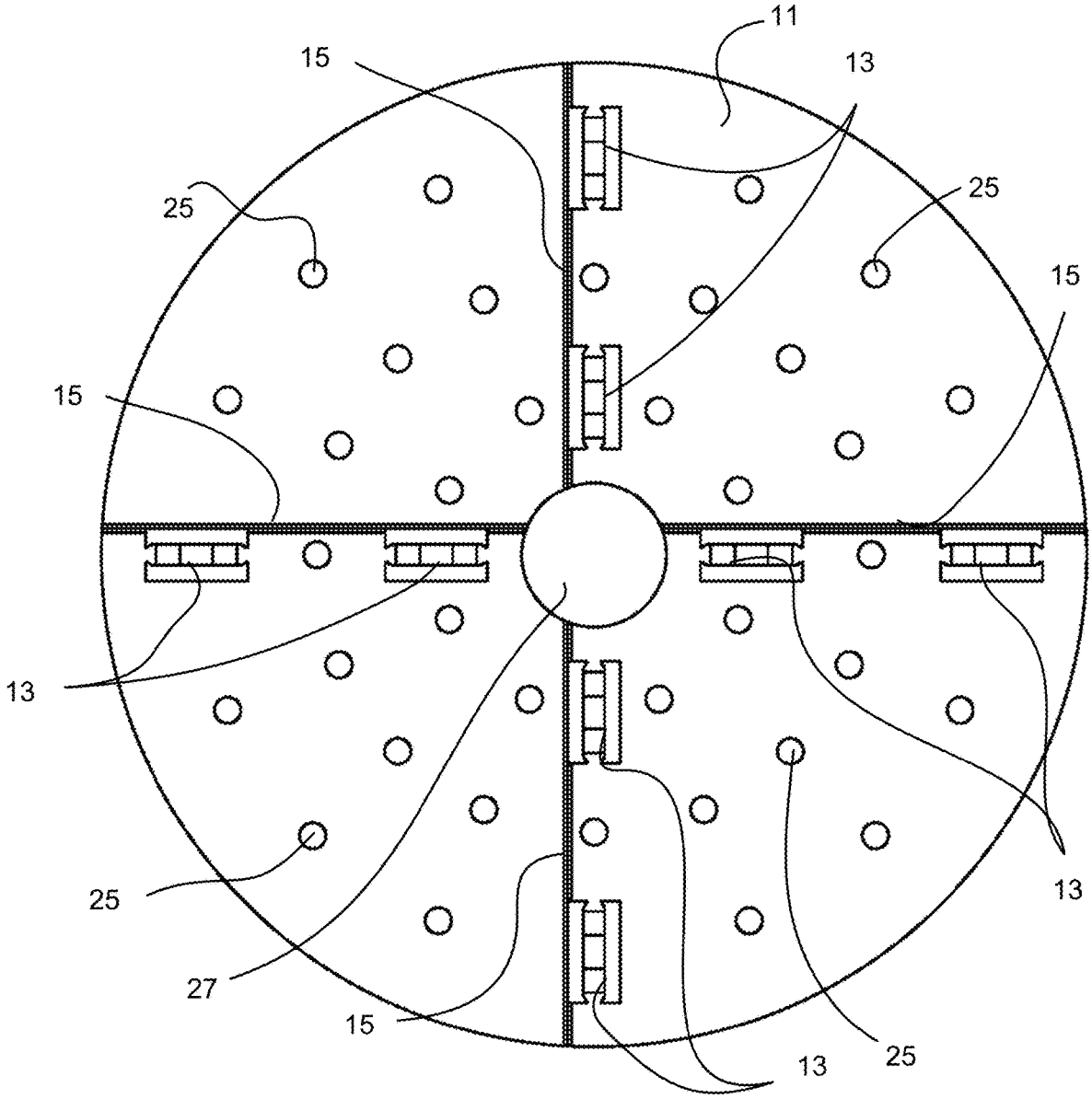
FIG. 5 is a bottom view drawing illustrating one embodiment of a tile leveler.

FIG. 5 is a bottom view drawing illustrating one embodiment of a tile leveler 10. The base 11 is shown with the brake lines 15, joint spacers 13, mortar passages 25, and hole 27.

Figure 6A:
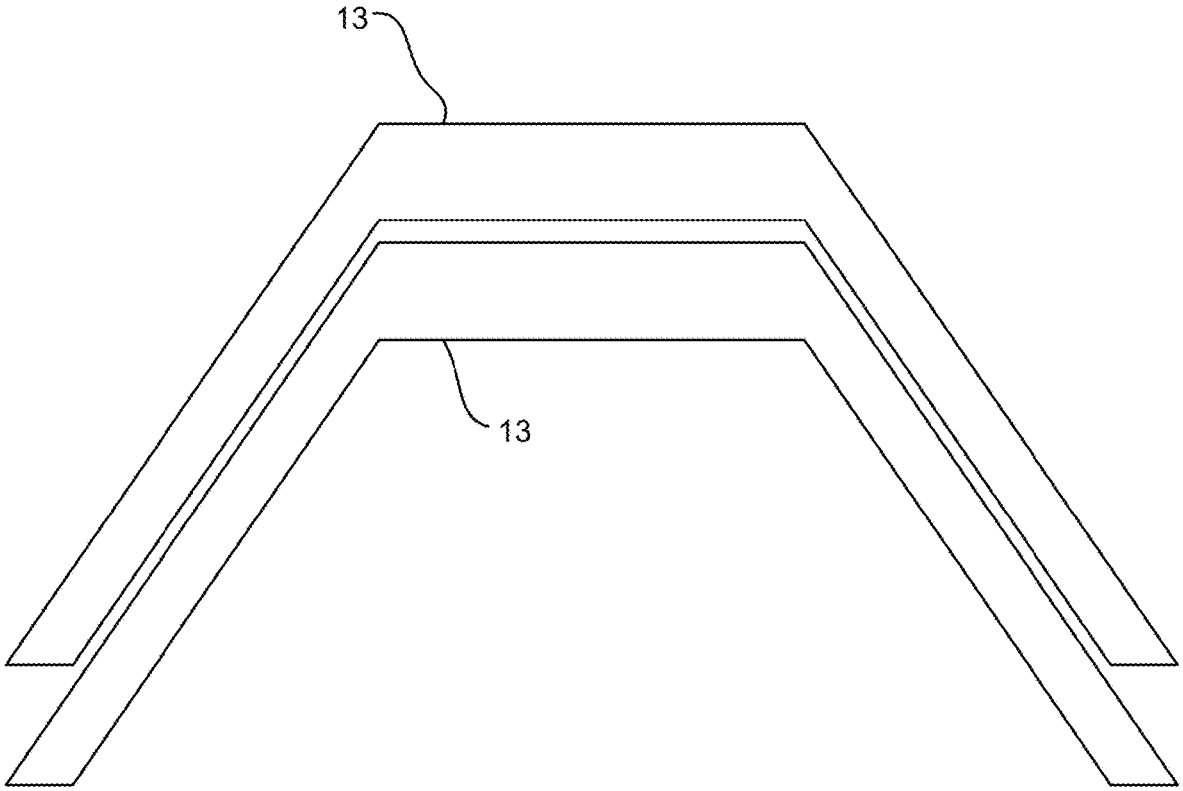
FIG. 6A is a side view drawing illustrating one embodiment of joint spacers.

FIG. 6A is a side view drawing illustrating one embodiment of joint spacers 13. In the depicted embodiment, the joint spacers 13 are isosceles trapezoids. In addition, the joint spacers 13 may be stackable. As a result, the tile levelers 10 may be efficiently stacked in a small volume and economically packaged.

Figure 6B:
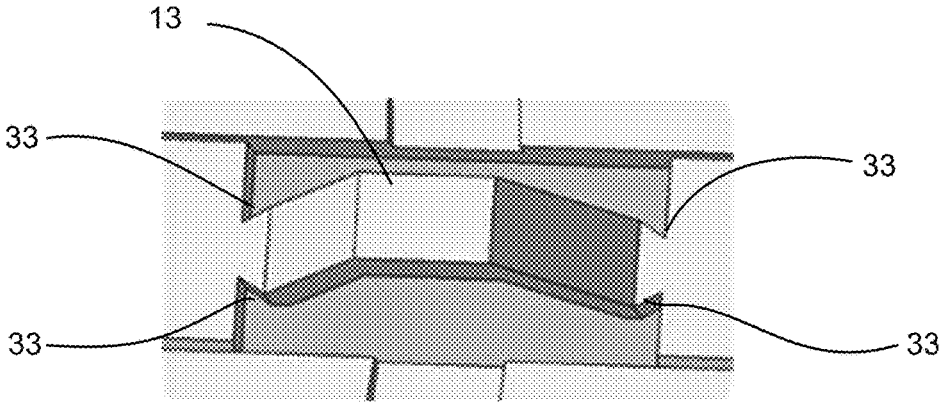
FIG. 6B is a perspective drawing illustrating one embodiment of a joint spacer.

FIG. 6B is a perspective drawing illustrating one embodiment of a joint spacer 13. In the depicted embodiment, the joint spacer 13 includes one or more break notches 33. The break notches 33 thin the connection of the joint space 13 to the base 11. In one embodiment, the joint spacer 13 may be disconnected and removed by hand from the base 11.

Figure 7:
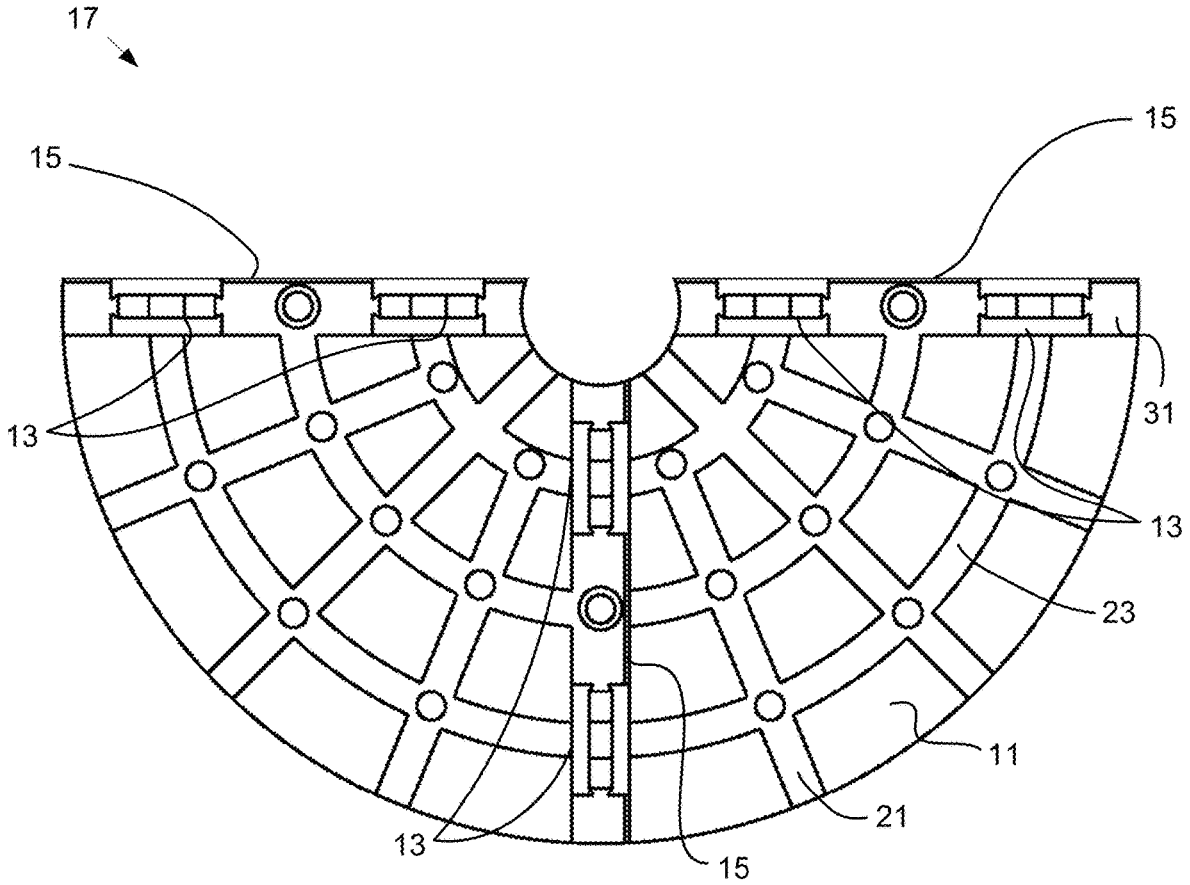
FIG. 7 is a top view drawing illustrating one embodiment of a half section of the tile leveler.

FIG. 7 is a top view drawing illustrating one embodiment of a half section 17 of the tile leveler 10. In the depicted embodiment, the tile leveler 10 was divided along the first brake line 15 into a section 17. The section 17 may be a half section 17. Alternatively, the section 17 may be greater than a half section 17. In addition, the section 17 may be less than a half section 17.

Figure 8:
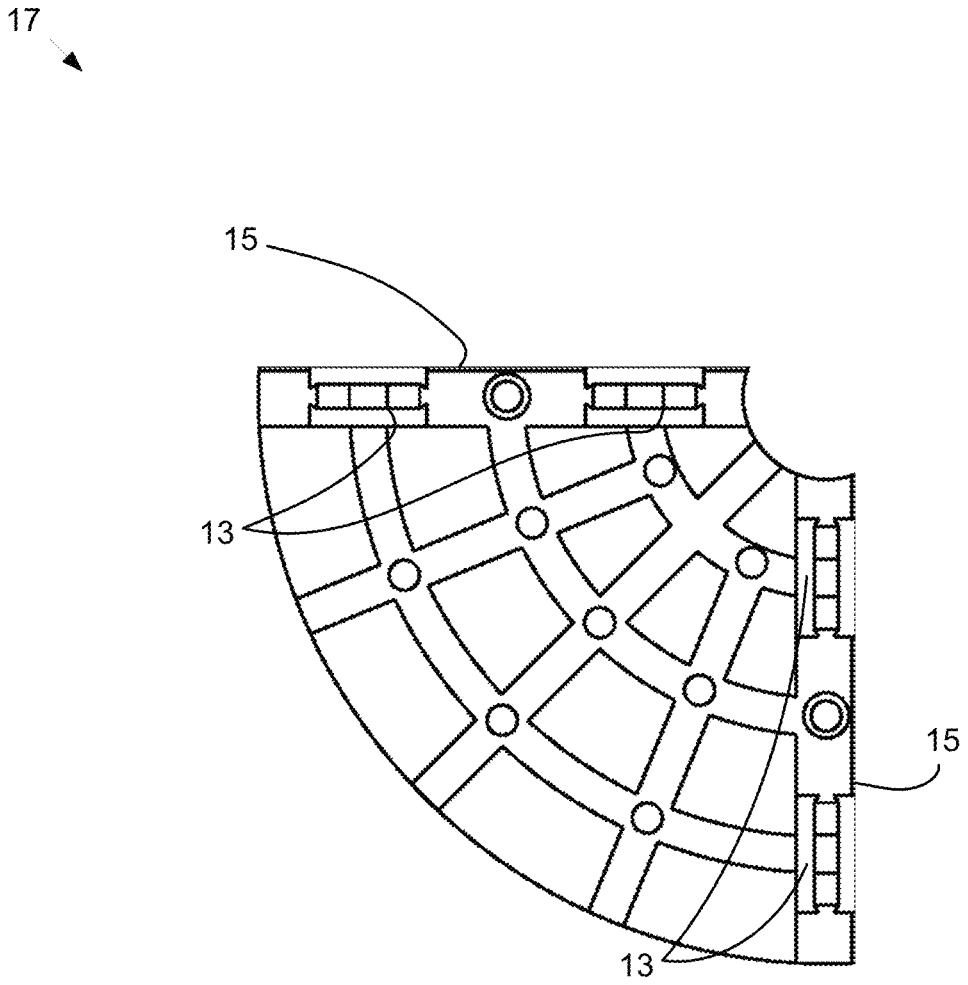
FIG. 8 is a top view drawing illustrating one embodiment of a quarter section of the tile leveler.

FIG. 8 is a top view drawing illustrating one embodiment of a quarter section of the tile leveler 10. In the depicted embodiment, the tile leveler 10 is divided along both the first brake line 15 and the second brake line 15 into a section 17. The section 17 is a quarter section 17. Alternatively, the section 17 may be greater than a quarter section 17. In addition, the section 17 may be less than a quarter section 17.

Embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A tile leveler comprising:

a base comprising two or more mortar passages wherein each mortar passage is disposed in a radial trench and/or a circular trench;

a plurality of joint spacers; and two or more break formed in the base along planar axes, wherein each joint spacer is within a subdivision distance of a break line, each joint spacer adjacent to a given break line is on a spacer side of the given break line, and the break lines divide the base into sections.

2. The tile leveler of claim 1, the base further comprising two or more radial trenches, wherein each break line is disposed in a radial trench.

3. The tile leveler of claim 1, the base further comprising one or more circular trenches.

4. The tile leveler of claim 1, wherein the two or more break lines comprise a segment of base material thinned to a break thickness the range of 1.0 to 1.5 millimeters.

5. The tile leveler of claim 4, wherein the two or more break lines are formed as an angled trench in the base.

6. The tile leveler of claim 1, wherein the base is circular.

7. The tile leveler of claim 1, wherein the plurality of joint spacers are an isosceles trapezoid.

8. The tile leveler of claim 7, wherein the plurality of joint spacers are stackable.

* * * * *